US006425184B1

(12) United States Patent
Min

(10) Patent No.: US 6,425,184 B1
(45) Date of Patent: Jul. 30, 2002

(54) WET SHAVING RAZOR HAVING A BLADE ASSEMBLY MOVEABLE IN A PLURALITY OF DIRECTIONS

(76) Inventor: Bo Sik Min, #202, Chowon Villa, 106-5, Munjeong-dong, Songpa-gu, Seoul, 138-200 (KR)

( * ) Notice: Subject to any disclaimer, the term of this patent is extended or adjusted under 35 U.S.C. 154(b) by 0 days.

(21) Appl. No.: 09/397,919

(22) Filed: Sep. 17, 1999

(51) Int. Cl.[7] ..... B26B 21/52
(52) U.S. Cl. ..... 30/527; 30/51; 30/526
(58) Field of Search ..... 30/34.05, 47, 50, 30/51, 57, 62, 526, 527, 529, 530, 531, 532, 533

(56) References Cited

U.S. PATENT DOCUMENTS

| | | | | | |
|---|---|---|---|---|---|
| 958,699 | A | * | 5/1910 | Durand | 30/51 |
| 1,331,784 | A | * | 2/1920 | Butterfield et al. | 30/34.05 X |
| 1,403,936 | A | * | 1/1922 | Behrman | 30/57 |
| 1,461,168 | A | * | 7/1923 | Watt | 30/57 |
| 2,060,445 | A | * | 11/1936 | Ryley | 30/527 |
| 2,103,924 | A | * | 12/1937 | Young | 30/527 X |
| 2,246,368 | A | * | 6/1941 | Kuhnl | 30/34.05 |
| 2,333,743 | A | * | 11/1943 | Sampson | 30/47 X |
| 4,266,340 | A | * | 5/1981 | Bowman | 30/532 |
| 4,347,663 | A | * | 9/1982 | Ullmo | 30/527 X |
| 4,378,633 | A | * | 4/1983 | Jacobson | 30/47 |
| 5,953,825 | A | * | 9/1999 | Christman et al. | 30/527 |

* cited by examiner

*Primary Examiner*—Clark F. Dexter
(74) *Attorney, Agent, or Firm*—Birch, Stewart, Kolash & Birch, LLP

(57) ABSTRACT

A wet shaving razor is provided with a first support formed on a handle and including a guiding groove formed at a middle portion of an upper surface thereof, and a pair of spring grooves formed on both lateral sides of the guiding groove, respectively, each of the spring grooves having a stepped portion, first springs being mounted within the spring grooves, respectively, a movable member movably mounted in the first support and including lateral wings inserted into the spring grooves, respectively, and an abutment member resiliently supported with respect to the movable member by a second spring and a blade receiving plate on which the blade assembly is mounted, a center lower end of the blade receiving plate hinged at the movable member, the blade receiving plate including an engaging hole at its rear surface into which the abutment member is engaged.

4 Claims, 10 Drawing Sheets

WET SHAVING RAZOR HAVING A BLADE ASSEMBLY MOVEABLE IN A PLURALITY OF DIRECTIONS

FIELD OF THE INVENTION

The present invention relates to a wet shaving razor; and, more particularly, to a wet shaving razor wherein a blade assembly is resiliently supported in a plurality of directions, thereby providing a good shaving performance and convenience during the shaving, since the blade assembly can comply with the contour of the user's face, easily changing its orientation and positions on the face.

DESCRIPTION OF THE PRIOR ART

In general, the razor is largely divided into a razor or a wet shaving razor and an electric razor. Because the electric razor which is normally used to cut short mustaches or whiskers can not guarantee a cleared smooth face and is expensive, the wet shaving razor is needed.

The wet shaving razor is divided into a handle and a head on which the razor blade is mounted. The wet shaving razor is also divided into a disposable or instant razor and a high classed razor. The instant razor has a handle and the head integrally formed with the handle, so that the razor blade of the instant razor can not move resiliently during the shaving, often allowing skin or face to be cut.

The high classed razor has a handle and a head physically separated from the handle, so that the razor blade moves resiliently during the shaving. The high classed razor can guarantee a more cleaned and smooth face, reducing a possibility of cutting the face. In the high classed razor, because the handle and the head are resiliently connected to each other, a spring or the like absorbs a frictional force occurring from the contact between the face and the razor blade.

The frictional force occurring from the contact of the razor blade to the face causes a stress in an opposite direction to the movement of the whole razor assembly and a stress due to the rotational movement of the razor blade. The prior art razor, however, is designed to absorb or cushion mainly the stress in the direction where the whole razor assembly moves and does not fully cover the stress due to the rotational movement of the razor blade.

SUMMARY OF THE INVENTION

It is, therefore, a primary object of the invention to provide to a wet shaving razor wherein when a razor blade or blade assembly is contacted to the face for shaving, the blade assembly is resiliently kept on the face, smoothly running against and over a skin of the face.

The above and other objects of the invention are accomplished by providing a wet shaving razor provided with a handle and a blade assembly detachably mounted on the handle, the razor comprising: a first support formed on one end of the handle and including a guiding groove formed at a middle portion of an upper surface thereof, and a pair of spring grooves formed on both lateral sides of the guiding groove, respectively, each of the spring grooves having a stepped portion, first springs being mounted within the spring grooves, respectively; a movable member movably mounted in the first support and including lateral wings inserted into the spring grooves, respectively and an abutment member resiliently and movably supported with respect to the movable member by a second spring; and a blade receiving plate on which the blade assembly is mounted, a center lower end of the blade receiving plate hinged at the movable member, the blade receiving plate including an engaging hole at its rear surface into which the abutment member is engaged.

In accordance with one feature of the present invention, the movable member has a vertical hole vertically formed on a lead portion of the movable member, into which a rotating member having an semi-circle shaped portion is mounted. The rotating member rotatably is mounted in the vertical hole by using a pin, whose upper portion is hinged at the blade receiving plate.

In accordance with another feature of the present invention, a wet shaving razor comprises a support formed on the end of the handle and including a guiding groove formed at a middle portion of an upper surface thereof, and a pair of spring grooves formed on both lateral sides of the guiding groove, respectively, each of the spring grooves having a stepped portion, first springs being mounted within the spring grooves, respectively; a movable member movably mounted in the support and including lateral wings inserted into the spring grooves, respectively, and a spring receiver formed on an upper surface of the movable member and keeping therein a second spring; a blade assembly having a razor blade attached thereto and a female connection formed at a lower portion thereof; a blade receiving plate being insertable into the female connection and having a hinge assembly through which a pair of connection holes are formed, the hinge assembly rotatably connected to a lead of the movable member by inserting a pin through one of the connection holes and a hole of the movable member; and a movable hinge member resiliently supported by the second spring at its one end and having a hinge at the other end thereof, the movable hinge member being rotatable with respect to the hinge assembly by inserting a pin through the other of the connection holes and the hinge.

In accordance with another feature of the present invention, a wet shaving razor comprises a support formed on one end of the handle and including a guiding groove formed at a middle portion of an upper surface thereof, and a pair of spring grooves formed on both lateral sides of the guiding groove, respectively, each of the spring grooves having a stepped portion, first springs being mounted within the spring grooves, respectively; a movable member movably mounted in the support and including lateral wings inserted into the spring grooves, respectively, and a spring receiver formed on an upper surface of the movable member and keeping therein a second spring; a blade receiving plate having a hinge assembly through which a pair of connection holes are formed, the hinge assembly rotatably connected to a head of the movable member by inserting a pin through one of the connection holes and a hole of the movable member; and a link member resiliently supported by the second spring at its one end and having a hinge and a linkage rotatably mounted to the hinge at one end of the linkage, the linkage being rotatable with respect to the hinge assembly by inserting a pin through the other of the connection holes and the other end of the linkage.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Detailed description of the preferred embodiment of the present invention is now made with reference to accompanying drawings.

The inventive razor includes a first shock absorbing means for reducing or absorbing a shock or a frictional force which occurs when a razor blade makes its translational movement, e.g., in a direction parallel with a razor handle, and a second shock absorbing means for reducing and absorbing a shock or frictional force which occurs when the razor blade rotationally moves.

Figure 1:
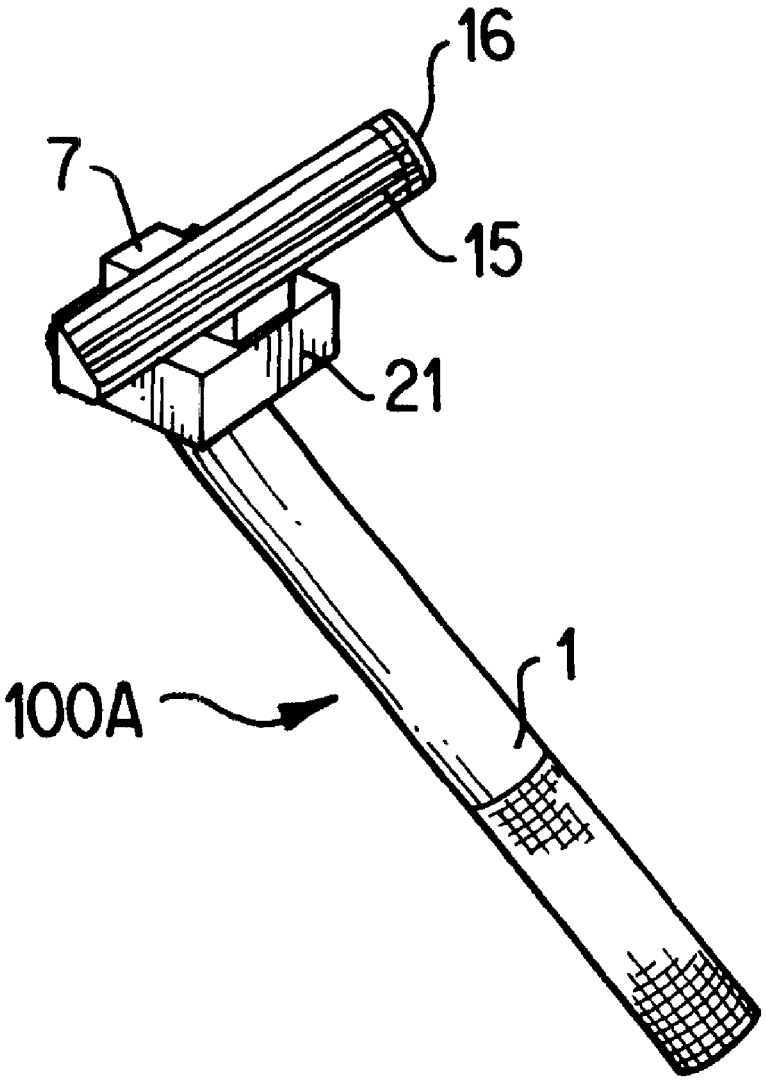
FIG. 1 shows a perspective view of a first embodiment of the inventive razor.
Figure 2:
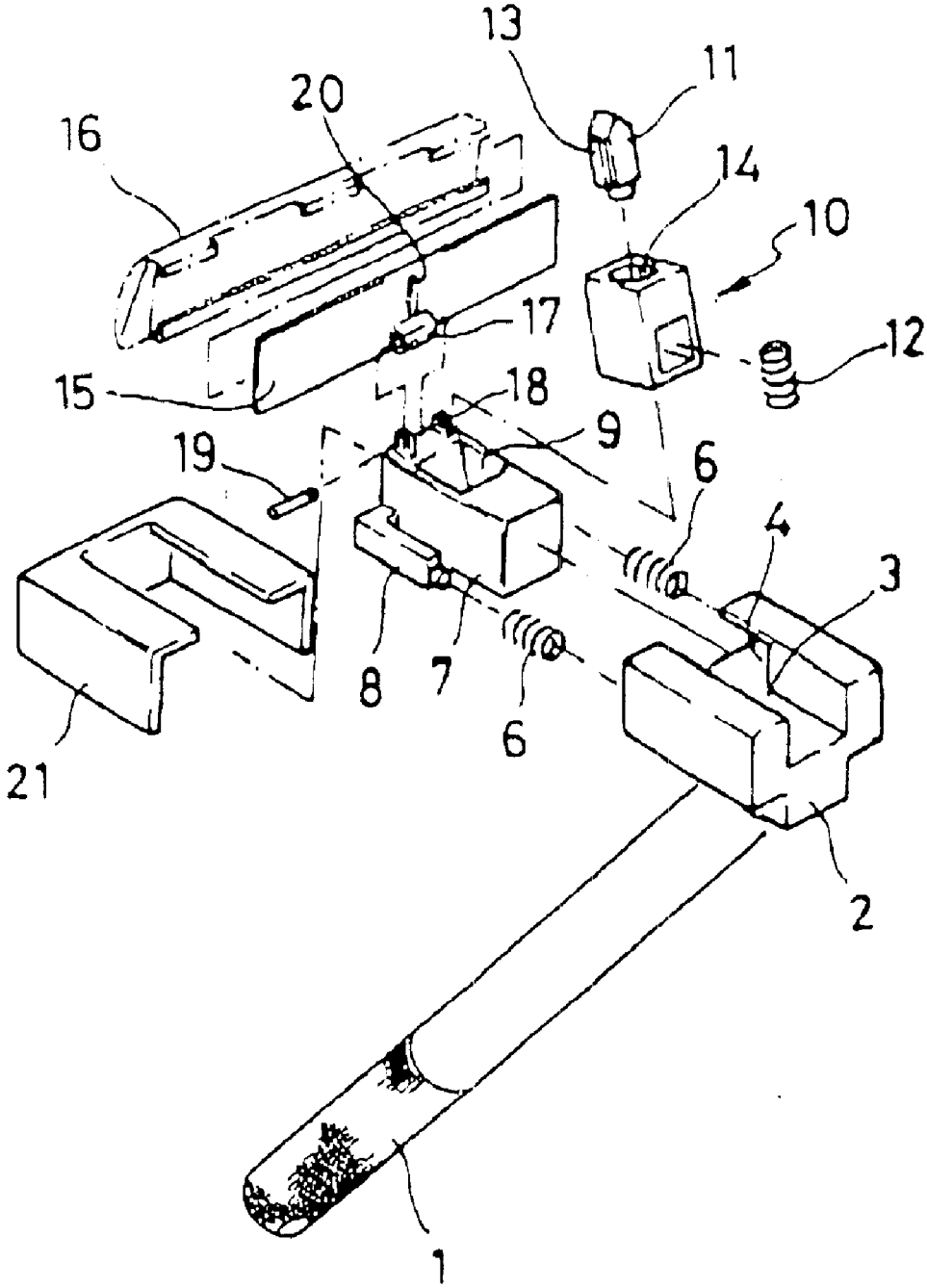
FIG. 2 illustrates an exploded perspective view of the first embodiment of the inventive razor.
Figure 3:
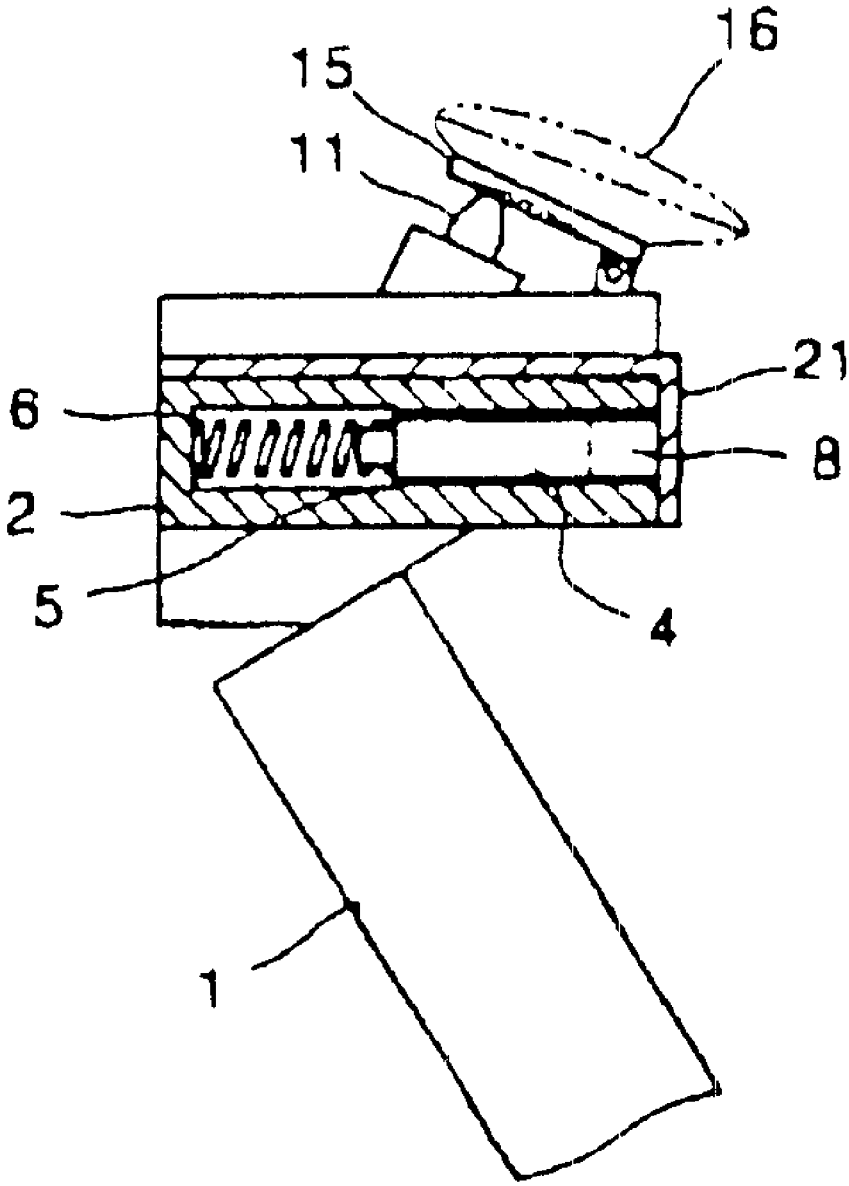
FIG. 3 depicts a sectional view of a spring of a first support shown in FIG. 2.
Figure 4:
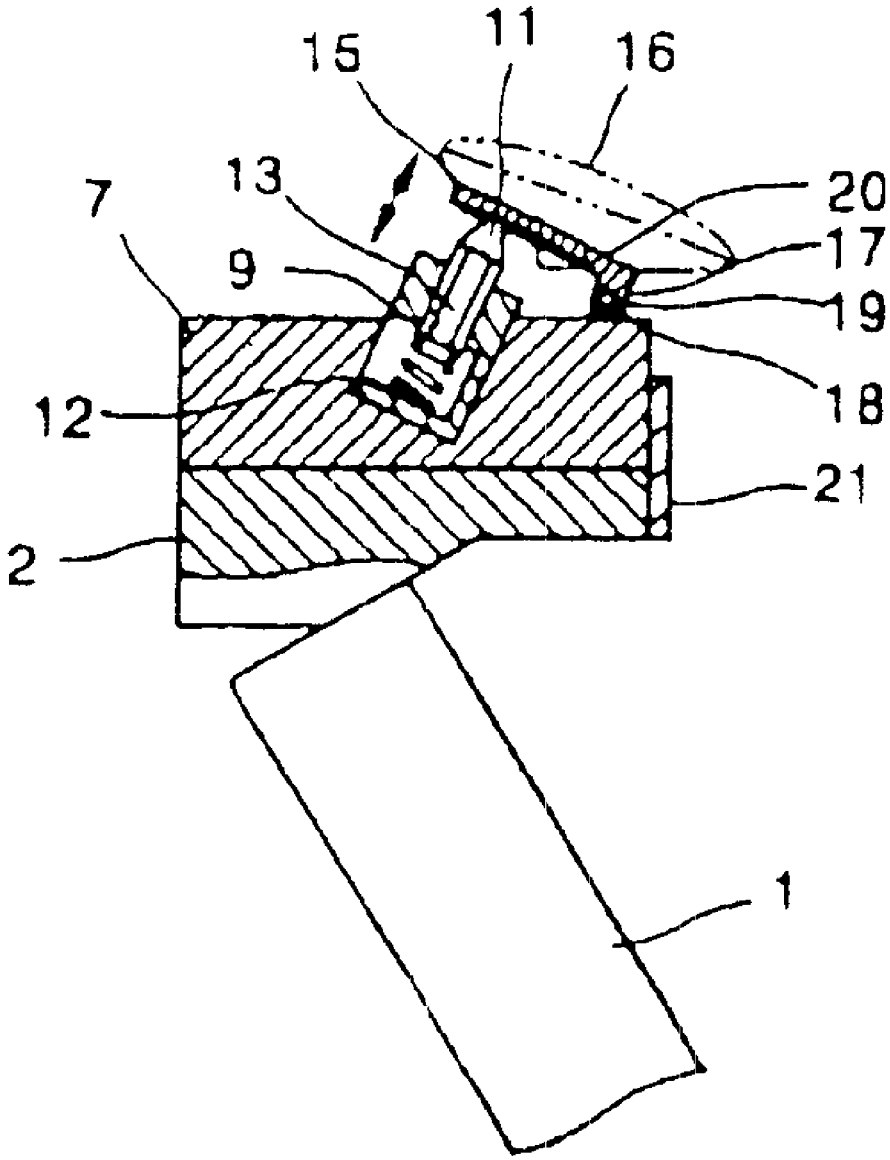
FIG. 4 presents a sectional view of a spring of a second support shown in FIG. 2.

FIG. 1 shows a perspective view of a first embodiment of the inventive razor; and FIG. 2 illustrates an exploded perspective view of the first embodiment of the inventive razor. Further, FIG. 3 depicts a sectional view of a spring of a first support shown in FIG. 2; and FIG. 4 presents a sectional view of a spring of a second support shown in FIG. 2. The described drawings disclose a first embodiment of the present invention.

Referring to FIGS. 1 through 4, the inventive razor 100A comprises a razor handle 1 having an elongated shape, a first support 2 formed on one end of the razor handle 1 at a proper angle with the razor handle 1, so that a razor blade can properly be contacted with a face of the user.

A guiding groove 3 is formed on a center portion of an upper surface of the first support 2. A pair of spring grooves 4 are formed on both lateral sides of the guiding groove 3 to extend in a parallel direction with the guiding groove 3. As shown in FIG. 3, each of the spring grooves 1 has a stepped portion 5 for preventing a spring 6 kept inside the spring groove 4 from deviating out of the spring groove 4.

A movable member 7 is assembled into the first support 2 in such a manner that it is movably engaged within the guiding groove 3 of the first support 2. The movable member 7 has a pair of lateral wings 8 formed on its lateral surfaces, which are engaged in the spring grooves 4, respectively, to be contacted to the springs 6, respectively. This configuration described above constitutes the first shock absorbing means employed in the first embodiment of the inventive razor.

Hereinafter, the second shock absorbing means will be described.

A slanted groove 9 is formed on a top surface of the movable member 7. Mounted and fixed in the slanted groove 9 is a second support 10 in which an abutment member 11 is resiliently supported by a spring 12.

On the other hand, the second support 10 may be integrally formed with the movable member 7 instead of being separated from the movable member 7, allowing the abutment member 11 and the spring 12 to be directly installed in the movable member 7. The abutment member 11 together with the second support 10 is installed in the movable member 7, being slanted with respect to the movable member 7. As a result, the abutment member 11 is at a right angle with a rotational direction of a blade receiving plate 15 which will be described later. The abutment member 11 has a guiding rail 13 formed on its surface, which is engaged with a rail groove 14 formed on an inner surface of the second support 10. The guiding rail 13 and the rail groove 14 ensure that the abutment member 11 can make an efficient rectilinear movement with respect to the second support 10.

The blade receiving plate 15 of a plate-like shape is assembled with the movable member 7, which can accommodate therein a blade assembly 16 or a blade cartridge well known in the art. The blade receiving plate 15 has a plate hinge 17 which is aligned with a pair of hinges 18 of the movable member 7. A pin 19 is inserted into the hinges 17 and 18, allowing the blade receiving plate 15 to be rotatable with respect to the movable member 7.

After the whole assembling process of the razor is completed, an end of the abutment member 11 comes into a contact with a rear surface of the blade receiving plate 15. In order to ensure a stable contact of the end of the abutment member 11 with the blade receiving plate 15, an engaging hole 20 is formed on the rear surface of the blade receiving plate 15.

As described above, the second shock absorbing means resiliently supports the blade receiving plate 15 in its rotational direction by the abutment member 11 installed in the movable member 7 and being slanted with respect to the movable member 7.

In order to prevent the movable member 7 being movable within the first support 2 from deviating from the first support 2, a cover 21 may be installed. It should be understood that various types of means for preventing the movable member 7 from deviating from the first support 2 can be used instead of the cover 21.

The inventive razor constructed in this manner is used after the blade assembly 16 is installed on the blade receiving plate 15. When the razor is moved by the user for shaving, the blade assembly 16 makes a translation movement along the movement of the user's hand, rotating about the hinge, according to a contour of the user's face. At that time, a frictional force in the direction along which the user's hand moves is reduced or absorbed by the first shock absorbing means where the movable member 7 resiliently moves against the spring 6. A stress due to the rotation of the blade assembly 16 is reduced or absorbed by the second shock absorbing means where the abutment member 11 resiliently moves against the spring 12.

Especially, the abutment member 11 and the spring 12 allow the blade receiving plate 15 to be resiliently rotated. That is, the rotational movement of the blade assembly 16 is converted into the rectilinear movement of the abutment member 11, absorbing the frictional force exerted on the blade assembly 16.

As described above, the present invention enables a proper close shaving without leaving any cut on the face by using the first and the second shock absorbing means.

Figure 5:
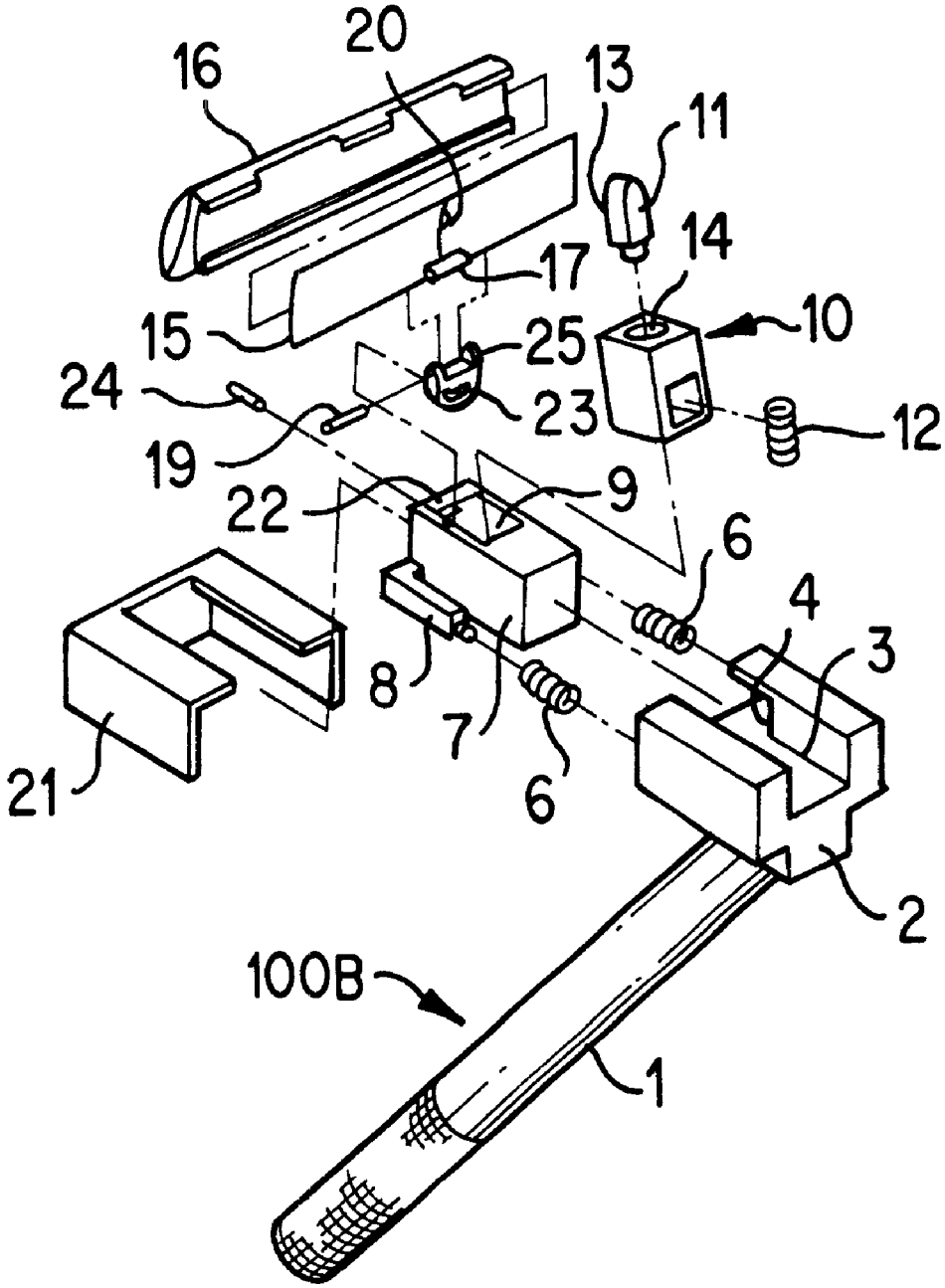
FIG. 5 gives an exploded perspective view of a second embodiment of the present invention.
Figure 6:
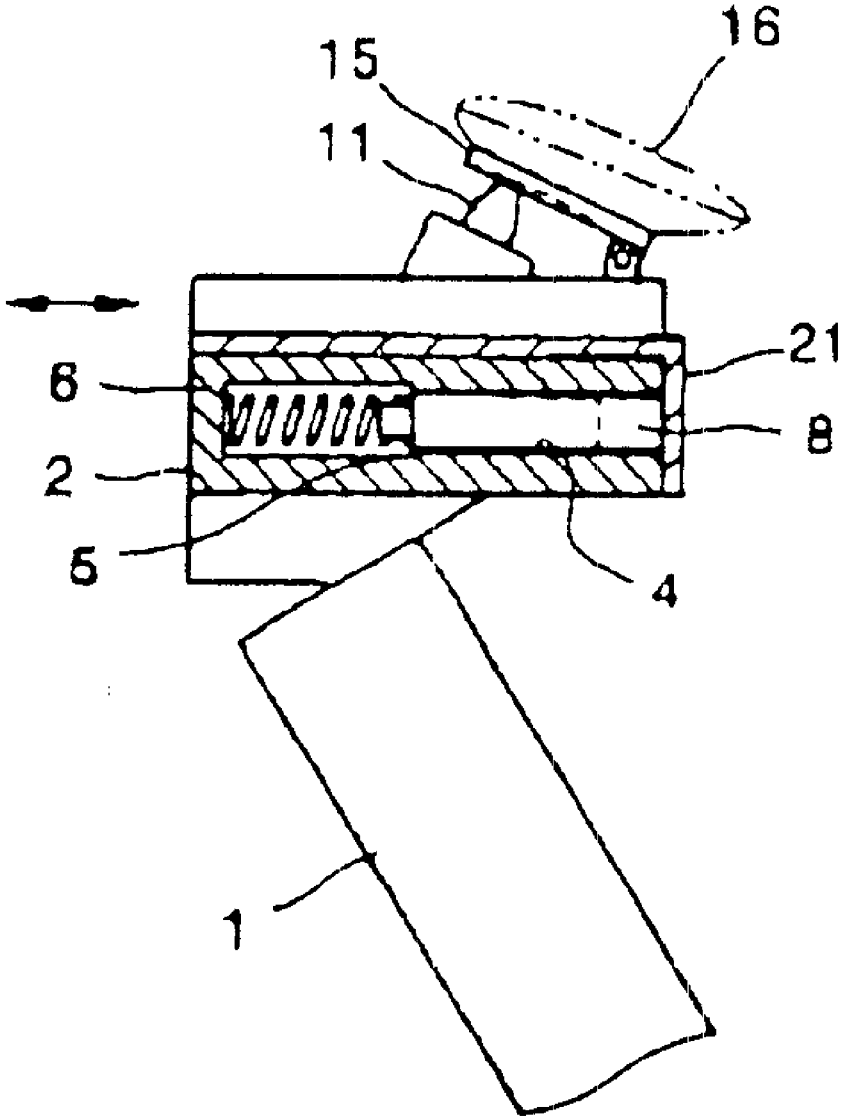
FIG. 6 illustrates a sectional view of a spring of a first support shown in FIG. 5.
Figure 7:
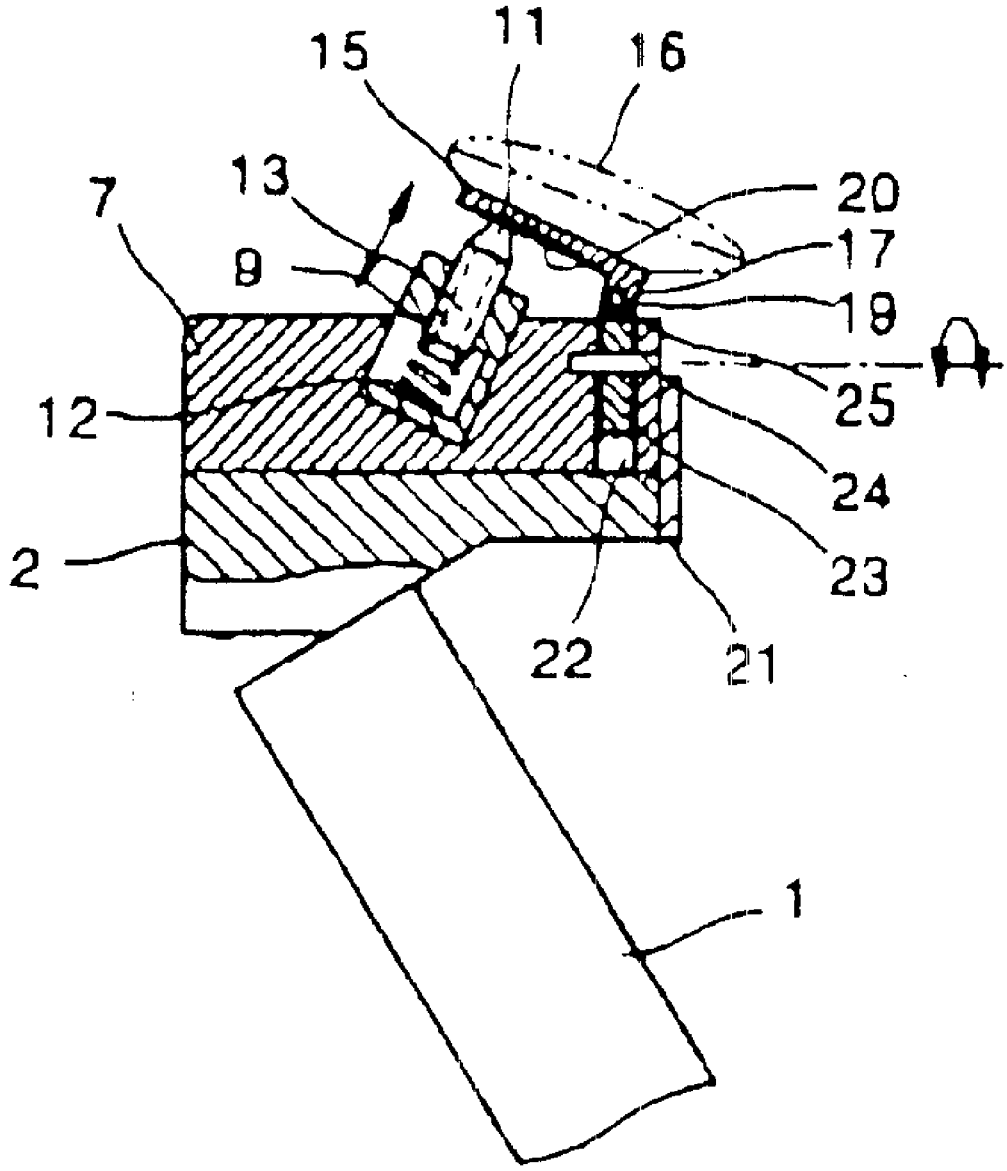
FIG. 7 presents a sectional view of a spring of a second support shown in FIG. 5.

On the other hand, FIG. 5 gives an exploded perspective view of another embodiment of razor 100B of the present invention; and FIG. 6 illustrates a sectional view of a spring of a first support shown in FIG. 5. FIG. 7 presents a sectional view of a spring of a second support shown in FIG. 5. The described drawings disclose a second embodiment of the present invention.

The second embodiment additionally comprises a third shock absorbing means, including major components of the first embodiment. Accordingly, a description on the components aforementioned in the first embodiment will not be given to avoid a repetition.

The third shock absorbing means enables an additional rotational movement of the blade assembly 16. As shown in FIGS. 5 to 7, the movable member 7 has a vertical hole 22 vertically formed on a head portion of the movable member 7, into which a rotating member 23 having an semi-circle shaped portion is mounted. The rotating member 23 is rotatably mounted in the vertical hole 22 by using a pin 24.

The rotating member 23 has a pair of hinges 25 formed at its upper portion, which is aligned with the hinge 17 to be combined therewith.

Accordingly, the blade receiving plate 15 becomes rotatable about the pin 24 through the use of the rotating member 23. However, even if the blade receiving plate 15 is rotated in a small amount, it immediately and naturally returns to its original center position, since the abutment member 11 is engaged into the engaging hole 20.

The third shock absorbing means is constructed as described above where the blade receiving plate 15 is rotatable about the pin 24 through the use of the rotating member 23. This construction allows the razor blade and the face to be closer to each other during shaving.

As described above, the present invention comprises the first shock absorbing means having the first support 2 formed on one end of the razor handle 1 and the movable member 7 adapted to be movable within the first support 2, and the second shock absorbing means having the blade receiving plate 7 assembled into the movable member 15 and the abutment member 11 resiliently supporting the blade receiving plate 15 with respect to the movable member 7, whereby the frictional force against the movement of the razor and the frictional force due to the rotational movement of the razor blade are absorbed or reduced, providing a good shaving performance. Further, the present invention has a reduced number of components to reduce the manufacturing cost of the razor. Furthermore, the present invention comprises the third shock absorbing means which allows the blade receiving plate 15 to be additionally rotatable, enabling a closer contact between the razor blade and the user's face.

A third embodiment of the present invention is now described with reference to FIGS. 8A and 8B. Same reference numerals will be used to represent the same components as the components shown in FIGS. 1 through 7.

In the third embodiment, the inventive razor 100C has a second shock absorbing means different from the second shock absorbing means in the previous embodiments.

Figure 8A:
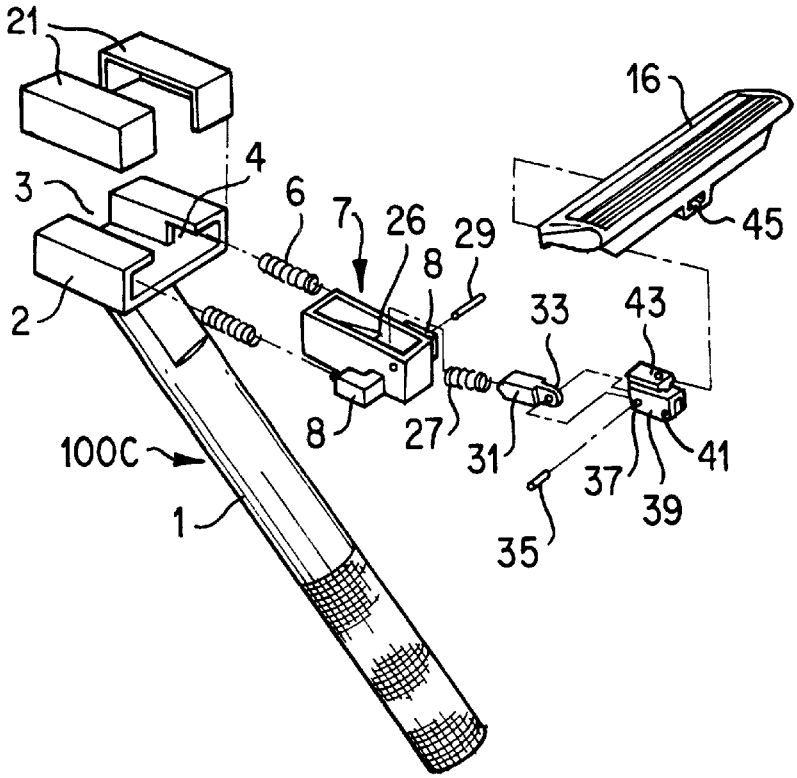
FIGS. 8A and 8B represent an exploded perspective view and a sectional view of a third embodiment of the present invention, respectively.
Figure 8B:
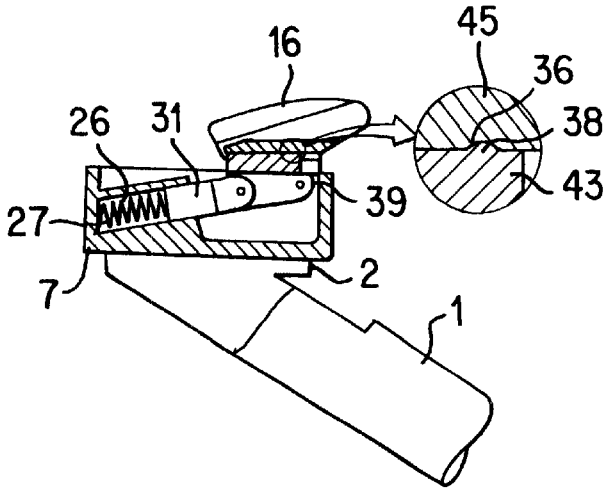

The movable member 7, has a spring receiver 26 formed therein at an upward acute angle with the movement direction of the movable member 7, in which a spring 27 is kept, as shown in FIGS. 8A and 8B.

A blade receiving plate 43 is assembled with the head of the movable member 7, which has a plate-like shape with a small width and can accommodate thereon the blade assembly 16 or the blade cartridge well known in the art.

For an installation of the blade assembly 16 on the blade receiving plate 43, the blade assembly 16 has at its lower portion a female connection 45 into which the blade receiving plate 43 is engaged, and the razor blade at its upper portion. As best illustrated in FIG. 8B, a convex 38 is formed on an upper surface of the blade receiving plate 43; and a concave 36 is formed on a position of the female connection 45 corresponding to the convex 38. The convex 38 and the concave 36 allow a stable engagement condition of the blade assembly 16 and the blade receiving plate 43. Further, the contact between the convex 38 and the concave 36 can be easily released by a force or predetermined level.

Formed with a lower portion of the blade receiving plate 43 is a hinge assembly 39 which has a pair of connection holes 41 and 37 formed therethrough. The connection hole 41 is aligned with a hole of the head of the movable member 7, and then a pin 29 is inserted into the connection hole 41 and the movable member 7, allowing the hinge assembly 39 to be rotatable with respect to the movable member 7.

One end of a movable hinge member 31 is movably received on the spring receiver 26. A hinge 33 is formed at the other end of the movable hinge member 31. The hinge 33 is aligned with the connection hole 37 and then a pin 35 is inserted into them, allowing the movable hinge member 31 to be rotatable about the connection hole 37.

This configuration where the movable hinge member 31 is resiliently supported, at its one end, by the spring 27 of the movable member 7 and is rotatably connected to the blade receiving plate 43, at the other end, constitutes the second shock absorbing means in the third embodiment of the present invention.

A fourth embodiment of the present invention is now described with reference to FIGS. 9A and 9B. Same reference numerals will be used to represent the same components as the components shown in FIGS. 1 through 8B.

In the fourth embodiment, the inventive razor 100D has a second shock absorbing means generally similar to but partially different from the second shock absorbing means in the third embodiment. Only difference between the third embodiment and the fourth embodiment will be described hereinafter.

Figure 9A:
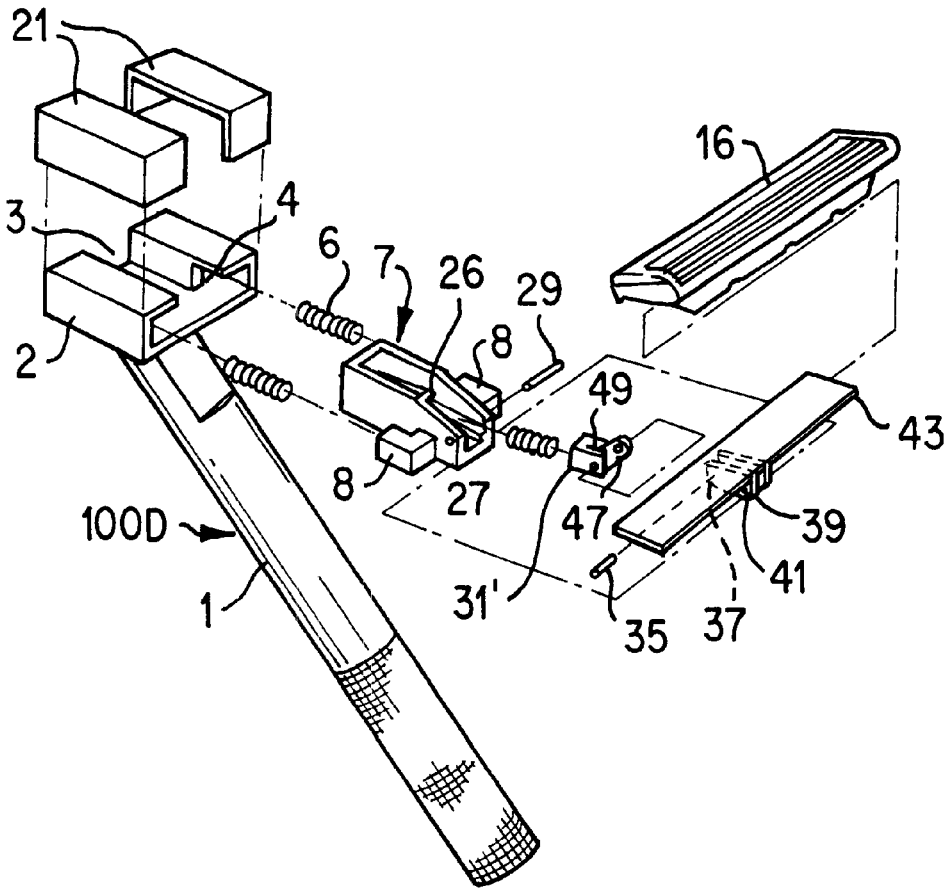
FIGS. 9A and 9B represent an exploded perspective view and a sectional view of a fourth embodiment of the present invention, respectively.
Figure 9B:
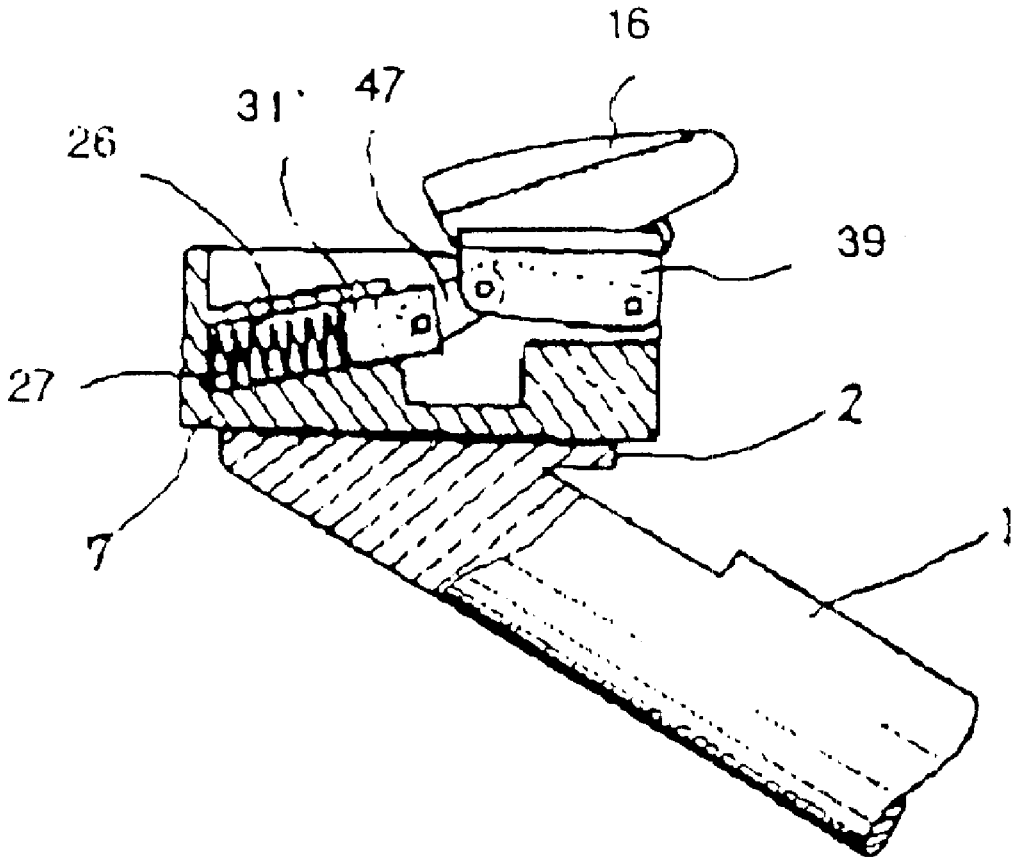

As shown in FIGS. 9A and 9B, unlike the movable hinge member 31 in FIGS. 8A and 8B, a link member 31' has a hinge 49 and a linkage 47 rotatably mounted to the hinge 49 at one end of the linkage 47. The other end of the linkage 47 is rotatably connected to the connection hole 37. Further, a blade receiving plate 43' which has a plate-like shape with a larger width than that of the blade receiving plate 43 and can accommodate thereon the blade assembly 16 or the blade cartridge well known in the art. The blade receiving plate 43' has the hinge assembly fixed to a bottom surface thereof. In this case, the blade assembly 16 is located on the blade receiving plate 43' by pushing the blade assembly 16 from a lateral side of the blade receiving plate 43'.

Although the invention has been shown and described with respect to the preferred embodiments, it will be understood by those skilled in the art that various changes and modifications may be made without departing from the spirit and scope of the invention as defined in the following claims.

What is claimed is:

1. A wet shaving razor provided with a handle and a blade assembly detachably mounted on the handle, the razor comprising:

a first support formed on one end of the handle and including a guiding groove formed at a middle portion of an upper surface thereof, and a pair of spring grooves formed on both lateral sides of the guiding groove, respectively, each of the spring grooves having a stepped portion, and first springs being mounted within the spring grooves, respectively;

a movable member movably mounted in the guiding groove and including lateral wings inserted into the spring grooves, respectively, and an abutment member resiliently and movably supported by the movable member by a second spring; and a blade receiving plate on which the blade assembly is mounted, a center lower end of the blade receiving plate hinged to the movable member, the blade receiving plate including an engaging hole at its rear surface into which the abutment member is engaged.

2. The wet shaving razor of claim 1, wherein said movable member has a vertical hole vertically formed on a lead portion of the movable member, into which a rotating member having an semi-circle shaped portion is mounted, the rotating member rotatably mounted in the vertical hole by a pin, and an upper portion of the rotating member hinged to the blade receiving plate.

3. A wet shaving razor provided with a handle, the razor comprising:

a support formed on one end of the handle and including a guiding groove formed at a middle portion of an upper surface thereof, and a pair of spring grooves formed on both lateral sides of the guiding groove, respectively, each of the spring grooves having a stepped portion, and first springs being mounted within the spring grooves, respectively;

a movable member movably mounted in the guiding groove and including lateral wings inserted into the spring grooves, respectively, and a spring receiver formed on an upper surface of the movable member and keeping therein a second spring;

a blade assembly having a razor blade attached thereto and a female connection formed at a lower portion thereof;

a blade receiving plate being removably received in the female connection and having a hinge assembly through which a pair of connection holes are formed, the hinge assembly rotatably connected to a head portion of the movable member by a pin inserted through one of the connection holes and a hole of the movable member; and a movable hinge member resiliently supported by the second spring at its one end and having a hinge at the other end thereof, the movable hinge member being rotatable with respect to the hinge assembly by a pin inserted through the other of the connection holes and the hinge.

4. A wet shaving razor provided with a handle and a blade assembly detachably mounted on the handle, the razor comprising:

a support formed on one end of the handle and including a guiding groove formed at a middle portion of an upper surface thereof, and a pair of spring grooves formed on both lateral sides of the guiding groove, respectively, each of the spring grooves having a stepped portion, and first springs being mounted within the spring grooves, respectively;

a movable member movably mounted in the guiding groove and including lateral wings inserted into the spring grooves, respectively, and a spring receiver formed on an upper surface of the movable member and keeping therein a second spring;

a blade receiving plate on which the blade assembly is mounted, the blade receiving plate having a hinge assembly through which a pair of connection holes are formed, the hinge assembly rotatably connected to a lead portion of the movable member by a pin inserted through one of the connection holes and a hole of the movable member; and a link member resiliently supported by the second spring at its one end and having a hinge, and a linkage rotatably mounted to the hinge at one end of the linkage, the linkage being rotatable with respect to the hinge assembly by a pin inserted through the other of the connection holes and the other end of the linkage.

* * * * *